US006964135B1

(12) United States Patent
Slodov

(10) Patent No.: US 6,964,135 B1
(45) Date of Patent: Nov. 15, 2005

(54) RAIN GUTTER CLEAN OUT DEVICE

(76) Inventor: Andrew Slodov, 1625 N. Park Blvd., Cleveland Heights, OH (US) 44106

( * ) Notice: Subject to any disclaimer, the term of this patent is extended or adjusted under 35 U.S.C. 154(b) by 0 days.

(21) Appl. No.: 10/886,194

(22) Filed: Jul. 7, 2004

(51) Int. Cl.[7] ..... E04D 13/064

(52) U.S. Cl. ..... 52/11; 52/95; 52/302.1; 52/302.3; 52/302.7

(58) Field of Search ..... 52/11–16, 94–95, 52/302.1; 239/208–209, 532; 294/19.1; 134/166 R, 134/201; 248/48.1, 48.2; 15/236.04; 405/118–122; 210/374

(56) References Cited

U.S. PATENT DOCUMENTS 3,743,339 A * 7/1973 Brackett ..... 294/19.1
3,977,135 A * 8/1976 Hunley, Jr. ..... 52/12
4,061,151 A * 12/1977 Ward ..... 134/33
4,116,008 A * 9/1978 Ward ..... 405/119
4,253,281 A * 3/1981 Ruttenberg ..... 52/12
4,696,131 A * 9/1987 Schreffler ..... 52/11
4,807,406 A * 2/1989 Densmore ..... 52/11
4,852,308 A * 8/1989 Papenbrock et al. ..... 52/12
5,038,530 A * 8/1991 Watkins ..... 52/63
5,127,200 A * 7/1992 Doran ..... 52/12
5,357,719 A * 10/1994 Lewis ..... 52/11
5,586,837 A * 12/1996 Udelle ..... 52/12
5,650,065 A * 7/1997 Sewell ..... 210/166
5,867,945 A * 2/1999 Scafidi ..... 52/16
6,076,307 A * 6/2000 Kean ..... 52/11
6,217,756 B1 * 4/2001 Martinez ..... 210/163
6,397,526 B1 * 6/2002 Saul et al. ..... 52/16
6,406,620 B1 * 6/2002 Rogers ..... 210/155
6,647,670 B1 * 11/2003 Dran ..... 52/16

* cited by examiner

*Primary Examiner*—Jeanette E. Chapman
(74) *Attorney, Agent, or Firm*—Thomas S. Baker, Jr.

(57) ABSTRACT

A rain gutter clean out device has a gutter section with a bottom wall opening and a slidable cover which in one position overlies the opening and in another position uncovers the opening to allow gutter debris to be removed there through.

7 Claims, 2 Drawing Sheets

RAIN GUTTER CLEAN OUT DEVICE

CROSS-REFERENCES

None.

FIELD OF THE INVENTION

The present invention relates to a clean out device for a rain gutter, and more specifically, relates to a device which enables a rain gutter to be flushed and cleaned by an operator standing on the ground.

Traditionally, rain gutter clean out has necessitated having a person climb a ladder and reach in a rain gutter with a hand or a hand implement to manually remove accumulated debris. The person's arm reach determined the length of rain gutter clean out that could be accomplished at each position of the ladder. Often, it was necessary to move the ladder longitudinally along the rain gutter from one end to the other to accomplish the manual clean out described above. In some cases, a rain gutter could not be reached conveniently by a ladder. In such instances, it was necessary for a maintenance person to climb onto a roof in order to reach the rain gutter. Ascending a ladder and climbing on a roof to accomplish cleaning a rain gutter have inherent dangers and best are avoided if possible. Additionally, because of the inconvenience involved in cleaning rain gutters, routine maintenance of rain gutters frequently is delayed. From the above it may be seen that there is a need for a rain gutter clean out device which will enable a person to clean rain gutters without ascending a ladder or climbing onto a roof structure.

DESCRIPTION OF THE PRIOR ART

Rain gutters have been attached to buildings for the purpose of collecting water running off of roof surfaces for many years. Typically, rain gutters collect the run off water and direct it to a vertical downspout in fluid communication with the rain gutter and with a surface water run off collection system which disposes of the water. This prevents water running off of a roof from collecting around the foundation of a structure and ultimately leaking into the base of the structure. Unfortunately, leaves and other debris often collect in rain gutters and ultimately interfere with the rain gutter water collection and disposal process. This necessitates rain gutter clean out and maintenance.

U.S. Pat. No. 4,407,097 to Allen discloses a rain gutter having a hinged end wall which permits the insertion of a water jet and a prodding rod for the purpose of flushing debris. The gutter end wall is pivotal between an open and closed position. An embodiment of a hinged trap door formed in the bottom of a rain gutter is also disclosed.

U.S. Pat. No. 4,696,131 to Schreffler discloses a cable operated gutter dumping device where the gutter is pivotal about a longitudinal axis.

U.S. Pat. No. 4,852,308 to Papenbrock et al. discloses a cable operated gutter cleaning system where the end of a gutter is removable to enable a flexible strip to be removed from the rain gutter and carry debris therefrom.

U.S. Pat. No. 5,255,477 to Goodspeed discloses a rain gutter clean out device having a pivotal hinged gutter section for cleaning purposes.

U.S. Pat. No. 4,117,635 to Nelson discloses a gutter which is rotatable about a longitudinal axis to cause dumping of gutter contents.

U.S. Pat. No. 4,183,368 to Husted discloses a water powered roof gutter flushing system.

While the above-identified devices may clean rain gutters, they are somewhat complex, expensive and in some cases necessitate a maintenance person having access to the roof gutter. Many of the devices require a number of manual operations and manipulations in order to accomplish cleaning of the rain gutter. The complexity of construction and/or operation of the aforementioned devices renders them impractical or too costly for most applications.

Additionally, implementation of many of the prior art devices require either extensive modification of a rain gutter or the entire replacement of a rain gutter structure. Of course, this renders such devices quite costly to purchase and install. From the above, it may be seen it is desirable to provide a rain gutter clean out device which is relatively simple and inexpensive to construct and install and may be utilized in conjunction with an existing rain gutter structure.

It is further desirable to provide a rain gutter clean out device which a maintenance person may utilize from the ground.

SUMMARY OF THE INVENTION

The present invention provides a rain gutter clean out apparatus and method which is relatively inexpensive to construct and install, may be installed on an existing rain gutter structure and subsequent to installation may be operated by a maintenance person standing on the ground.

The rain gutter clean out device of the instant invention utilizes a generally U-shaped gutter section adapted to be inserted as a section of a rain gutter having a bottom wall and a pair of upwardly extending side walls. The bottom wall has an opening formed therein. A cover overlies a portion of the bottom wall and is slidable between a first or closed position in which it overlies the bottom wall opening and a second or open or uncovered position in which it is spaced from the bottom wall opening. A spring biases the cover to the first or closed bottom wall opening position. A manual actuator in the form of a cable is attached to the slidable cover and extends longitudinally along the rain gutter and thereafter vertically downward such that it is easily accessible to a person at ground level. A water nozzle is mounted in the rain gutter remote from the rain gutter clean out device bottom wall opening. In order to accomplish rain gutter clean out, the cable is pulled to slide the cover to the second position which uncovers the opening in the rain gutter clean out device and thereafter a source of pressurized fluid is provided to the nozzle inlet which flushes debris in the rain gutter between the nozzle and the rain gutter clean out device toward the clean out device bottom wall opening. When the rain gutter is clean, the water supply to the water nozzle inlet is interrupted and the actuator cable is released to cause the spring to move the cover to the first or closed position.

Although the invention has been described broadly above, there are additional embodiments which will be described in the specification and drawings herein and which will form the subject matter of a number of claims.

It should be noted that the specification and drawings described herein are for illustrative purposes and that changes may be made to the construction details of the rain gutter clean out device without departing from the scope of the attached claims herein.

DESCRIPTION OF THE PREFERRED EMBODIMENT

Figure 1:
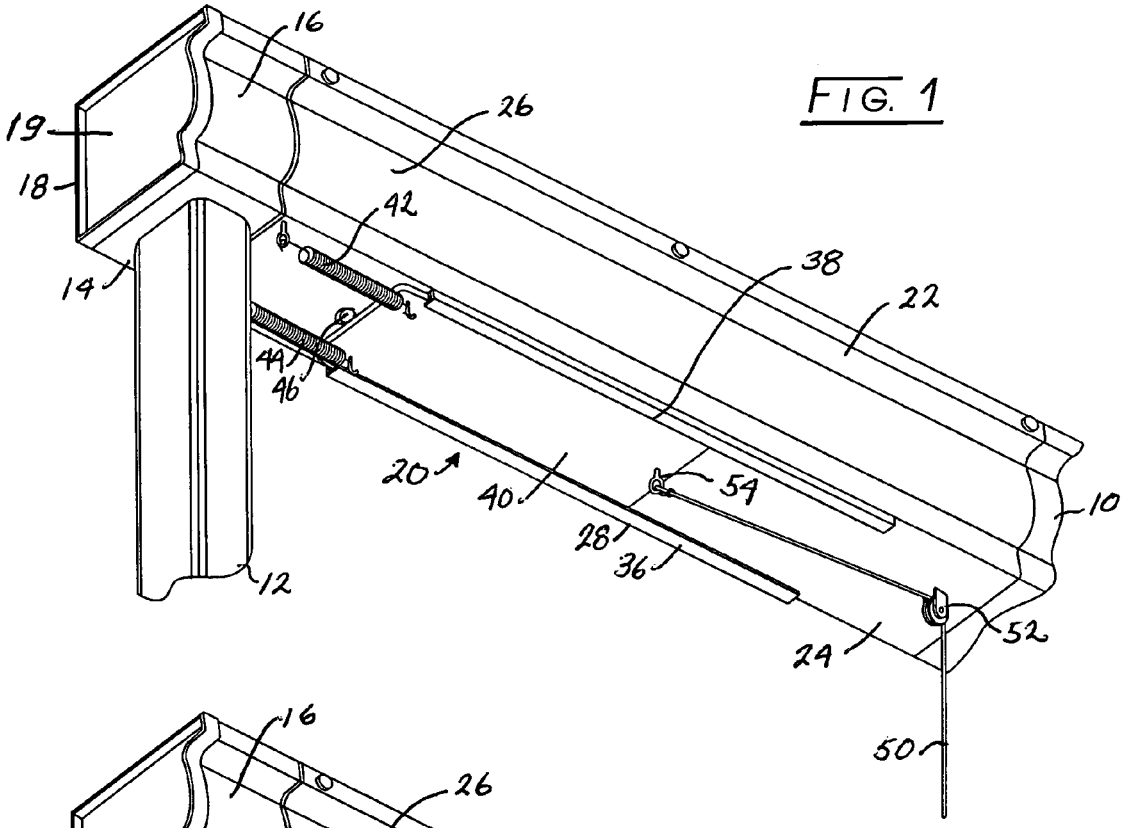
FIG. 1 is a perspective view of the rain gutter clean out device of the instant invention showing a spring biased slidable cover plate in a closed position.
Figure 2:
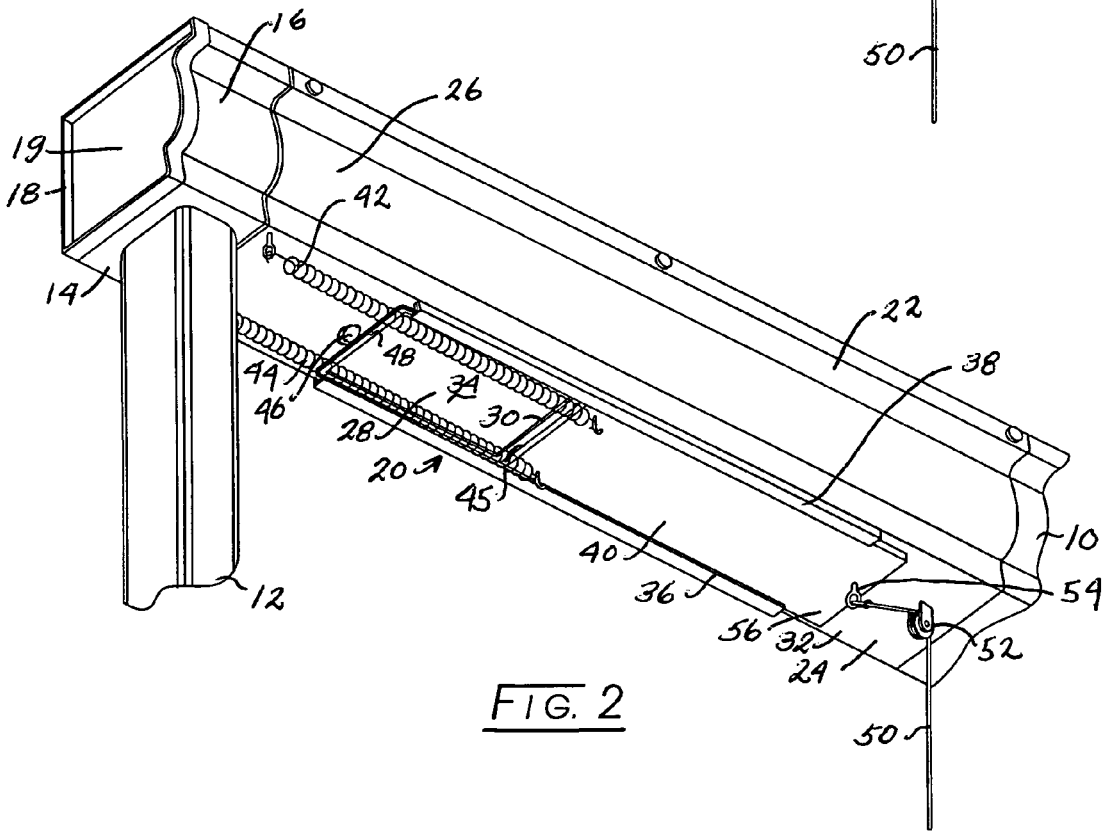
FIG. 2 is a view similar to FIG. 1 showing a spring biased slidable cover plate in an open position.

A conventional rain gutter 10 having an attached downspout 12 at one end thereof may be seen by referring to FIGS. 1 and 2 of the drawings. Rain gutter 10 has a generally U-shaped cross sectional configuration formed by a planar bottom wall 14, an upwardly extending front side wall 16, a planar upwardly extending rear side wall 18 adapted to engage a fascia board affixed to a building adjacent the edges of a roof (not shown) and an end cap 19. Water collected by rain gutter 10 is directed to downspout 12 which is connected to drain tile or other water conveyance devices (not shown).

A rain gutter clean out device 20 has a generally U-shaped gutter section 22 which substantially compliments the U-shaped cross section of rain gutter 10. U-shaped gutter section 22 has a planar bottom wall 24, an upwardly extending front side wall 26 and a planar upwardly extending rear side wall 28. Because the U-shaped gutter section 22 of rain gutter clean out device 20 compliments the shape of rain gutter 10, rain gutter clean out device 20 may be added to a section of rain gutter 10 in the same fashion as any other section of conventional rain gutter.

Referring again to FIGS. 1 and 2, it may be seen that U-shaped rain gutter section planar bottom wall 24 has a top surface 30 and a bottom surface 32. A generally rectangular shaped opening 34 is formed in bottom wall 24. A pair of longitudinally extending parallel guide members 36 and 38 are affixed to bottom surface 32 and extend along each side of opening 34. A cover 40 is retained and guided within guide members 36 and 38 and is slidable between a first position in which it overlies or closes bottom wall opening 34, as is illustrated in FIG. 1, and a second position in which it is spaced from or opens or uncovers bottom wall opening 34, as depicted in FIG. 2. A pair of springs 42 and 44 anchored to bottom wall surface 32 are connected to cover 40 and bias cover 40 towards the first position in which it overlies bottom wall opening 34. A stop 46 limits travel of cover 40 when it overlies bottom wall opening 34. Although two springs 42 and 44 are depicted as acting on cover 40, one or more springs may be utilized.

Referring to FIG. 2, it may be seen that a resilient seal 48 is affixed to the perimeter of bottom wall opening 34. The top surface 45 of cover 40 sealingly engages resilient seal 48 when it is in a closed position in which it overlies bottom wall opening 34, as depicted in FIG. 1. This prevents the leakage of fluid from rain gutter clean out device 20 when the device is not being utilized to clean out a rain gutter.

A cable 50 passes over a pulley 52 and attaches to an anchor 54 at the rear end 56 of cover 40. Pulley 52 may be affixed to the bottom wall 14 of rain gutter 10 and is located a distance from bottom wall opening 34 sufficient to ensure there is enough lateral distance for cover 40 to slide in guide members 36 and 38 to uncover bottom wall opening 34. Pulley 52 preferably is located where cable 50 may be easily accessed by a person on the ground or at any other desired location. For example, it may be desirable to locate cable 50 along a downspout 12 (not shown) affixed to a rain gutter at a location remote from rain gutter clean out device 20. It is desirable only that a person on the ground can access cable 50 such that when the cable is pulled cover 40 will slide within guide members 36 and 38 to uncover bottom wall opening 34. Thereafter, when cable 50 is released springs 42 and 44 will bias cover 40 into a position in which it overlies bottom wall opening 34.

Rain gutter clean out device 20 provides a means for removing debris from rain gutter 10 when a source of water flushes the debris towards bottom wall opening 34. Flushing of debris within rain gutter 10 may be accomplished by providing a source of pressurized water to rain gutter 10 at a location remote from clean out device 20 and flushing debris and water longitudinally along rain gutter 10 toward rain gutter clean out device 20 where debris and water are removed through bottom wall opening 34. The rain gutter clean out device 20 of the instant invention is adapted to be added to a rain gutter 10 by removing a section of rain gutter at a desired location and inserting a rain gutter clean out device 20 therein. A rain gutter clean out device 20 may be inserted at one or both ends of a rain gutter 10, as depicted in FIGS. 3 and 5 respectively, or at a position intermediate the ends, as depicted in FIG. 4.

Figure 3:
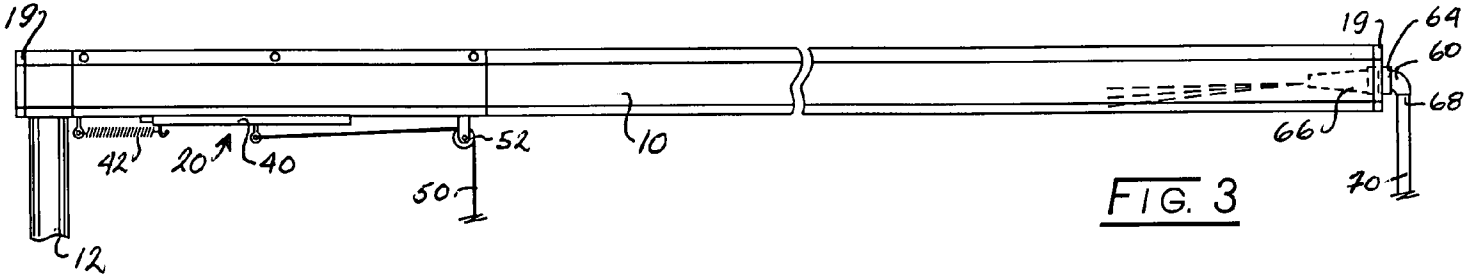
FIG. 3 is a side view of a rain gutter incorporating a rain gutter clean out device section at one end thereof and a water flush nozzle at the other end thereof.

Referring to FIG. 3, a water flush nozzle 60 is rigidly mounted within a rain gutter end cap 19 by a connector 64. Water flush nozzle 60 has a nozzle water outlet 66 positioned within rain gutter 10 and a nozzle water inlet 68 positioned outside of rain gutter 10 and connected to a fluid conduit 70 which provides a source (not shown) of pressurized water. Fluid conduit 70 may be a rigid tubing member or a hose. It is envisioned that fluid conduit 70 would be permanently attached to water flush nozzle 60 and plumbed to enable a person on the ground to provide water to fluid conduit 70 when it is desired to flush rain gutter 10.

In order to accomplish flushing of rain gutter 10, cable 50 is pulled to slide cover 40 to a position in which bottom wall 34 is uncovered and thereafter pressurized water is supplied to conduit 70. This causes debris within rain gutter 10 to be flushed towards bottom wall opening 34 and removed there through. After debris has been removed from rain gutter 10, the supply of pressurized water through fluid conduit 70 is interrupted and cable 50 is released to enable springs 42 and 44 to move cover 40 to the closed position in which it overlies bottom wall opening 34.

Figure 4:
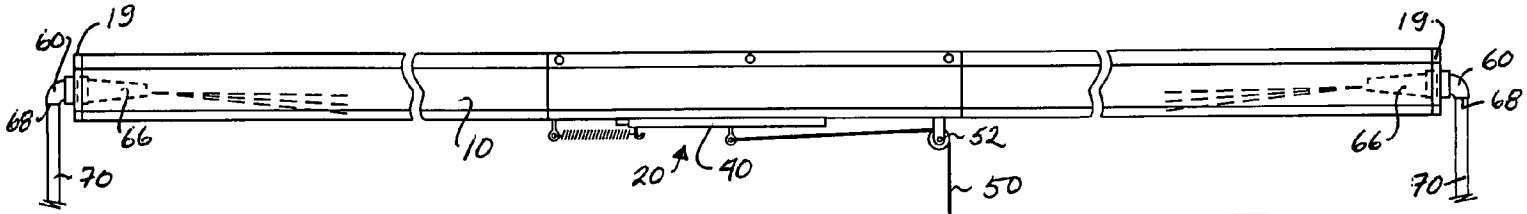
FIG. 4 is a side view of a rain gutter showing a rain gutter clean out device section incorporated in the center of the rain gutter and a pair of water flush nozzle inlets mounted at opposite ends of the rain gutter.
Figure 5:
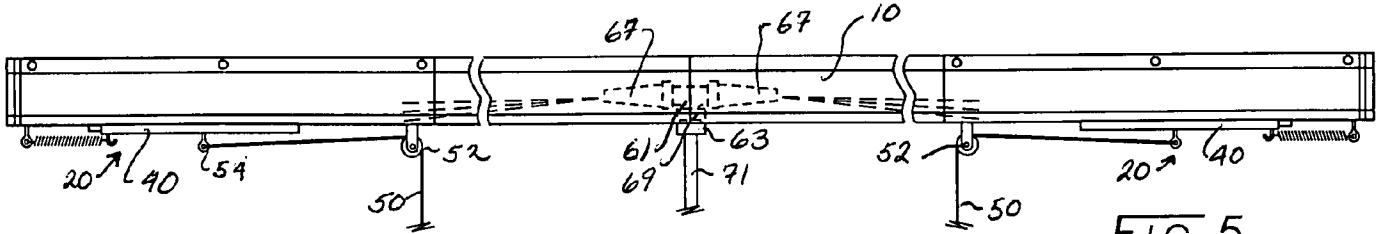
FIG. 5 is a side view of a rain gutter illustrating a rain gutter clean out device section mounted at each end of a rain gutter and a dual direction water flush nozzle mounted in the center of the rain gutter.

Referring to FIG. 4, it may be seen that a rain gutter clean out device 20 is at an intermediate position within rain gutter 20 and water flush nozzle 60 is mounted within a rain gutter end cap 19 at each end of rain gutter 10. With this arrangement, debris from both ends of rain gutter 10 is flushed towards centrally mounted rain gutter clean out device 20.

An alternate arrangement for a rain gutter clean out device 20 within a rain gutter 10 may be seen by referring to FIG. 5. In this embodiment, a pair of rain gutter clean out devices 20 are mounted one at each end of rain gutter 10. A dual direction water flush nozzle 61 is affixed to the bottom wall at the center of rain gutter 10 by a connector 63. Dual direction water flush nozzle 61 has a pair of nozzle water outlets 67, one facing each of the rain gutter clean out devices 20 and a nozzle water inlet 69 attached to a fluid conduit 71. With this embodiment, a single source of pressurized fluid causes debris to be flushed towards the rain gutter clean out devices 20 at each end of rain gutter 10 simultaneously. To operate the device, the cables 50 to the two rain gutter clean out devices 20 are pulled causing the covers 40 in each of the devices 20 to slide within their guide members and uncover the bottom wall openings 34. Thereafter, pressurized water is provided to fluid conduit 71 to enable water from nozzle water outlets 67 to simultaneously flush debris towards the two rain gutter clean out devices 20. Subsequent to removal of debris within rain gutter 10, the flow of pressurized water to conduit 71 is interrupted and cables 50 are released to cause covers 40 to overlie the bottom wall openings 34 formed in the rain gutter clean out devices 20.

Turning to the construction of the rain gutter clean out device of the instant invention described above, it should be noted that the optimum materials and dimensions for the components of the invention as well as their location and tolerances will be readily apparent to one skilled in the art. The drawings and the description of the invention set forth in the above specification are for illustrative purposes only. It is intended that all equivalent relationships to those set forth in the detailed description and drawings are to be encompassed by the subject invention.

Since numerous modifications and changes will be apparent to those skilled in the art, it is not desired to limit the invention to the exact construction and operation shown and described.

I claim as my invention:

1. A clean out device for a rain gutter which comprises:

a generally U-shaped gutter section having a bottom wall and a pair of upwardly extending side walls;

said bottom wall having an opening formed therein;

a cover which overlies a portion of said bottom wall slidable between a first position in which it overlies said bottom wall opening and a second position in which it is spaced from said bottom wall opening;

a spring biasing said cover to said first position;

said bottom wall having bottom and top surfaces; and a pair of spaced guide members attached to said bottom surface of said gutter section bottom wall which receive and guide said slidable cover.

2. The rain gutter clean out device of claim 1 wherein said guide members are positioned on opposite sides of said bottom wall opening.

3. A clean out device for a rain gutter which comprises:

a generally U-shaped gutter section having a bottom wall and a pair of upwardly extending side walls;

said bottom wall having an opening formed therein;

a cover which overlies a portion of said bottom wall slidable between a first position in which it overlies said bottom wall opening and a second position in which it is spaced from said bottom wall opening;

a spring biasing said cover to said first position; and a manual actuator attached to said cover and operable to overcome the biasing force of said spring to move said cover to said second position to uncover said gutter bottom wall opening.

4. The rain gutter clean out device of claim 3 further comprising a resilient seal mounted on the edge defining said bottom wall opening which engages said cover when said cover is in said first position.

5. The rain gutter clean out device of claim 3 further comprising a water nozzle mounted in the rain gutter having an inlet connected to a source of pressurized water and having an outlet in fluid communication with said rain gutter and said rain gutter clean out device bottom wall and said side walls and positioned such that water from said water nozzle flows within said rain gutter toward said opening in said rain gutter clean out device bottom wall.

6. A clean out device for a rain gutter which comprises:

a generally U-shaped gutter section having a bottom wall and a pair of upwardly extending side walls;

said bottom wall having an opening formed therein;

a cover which overlies a portion of said bottom wall slidable between a first position in which it overlies said bottom wall opening and a second position in which it is spaced from said bottom wall opening;

a spring biasing said cover to said first position; and a pair of water nozzles mounted in said rain gutter on opposite sides of and spaced from said opening in said rain gutter clean out device bottom wall, each having an inlet connected to a source of pressurized water and an outlet in fluid communication with said rain gutter and said rain gutter clean out device bottom wall and said side walls such that water from said pair of nozzle water outlets flows within said rain gutter toward said opening in said rain gutter clean out device bottom wall.

7. A clean out device for a rain gutter which comprises:

a generally U-shaped gutter section having a bottom wall and a pair of upwardly extending side walls;

said bottom wall having an opening formed therein;

a cover which overlies a portion of said bottom wall slidable between a first position in which it overlies said bottom wall opening and a second position in which it is spaced from said bottom wall opening; and a spring biasing said cover to said first position;

wherein a pair of said gutter clean out devices are mounted in spaced relation in a rain gutter; and a pair of water nozzles mounted in said rain gutter between said pair of spaced gutter clean out devices, said nozzles having inlets connected to a source of pressurized water and outlets positioned such that water from said each of said nozzles flows towards a different one of said pair of gutter clean out devices.

* * * * *